US007587850B2

(12) United States Patent
Vineyard

(10) Patent No.: US 7,587,850 B2
(45) Date of Patent: Sep. 15, 2009

(54) PICTURE FRAME ASSEMBLY INCORPORATING AN OUTER FRAME AND A BACKING MEMBER

(76) Inventor: Terry L. Vineyard, 1211 Highlandview Dr., Boise, ID (US) 83702

( * ) Notice: Subject to any disclaimer, the term of this patent is extended or adjusted under 35 U.S.C. 154(b) by 108 days.

(21) Appl. No.: 11/399,819

(22) Filed: Apr. 6, 2006

(65) Prior Publication Data

US 2007/0234620 A1 Oct. 11, 2007

(51) Int. Cl.
*A47G 1/06* (2006.01)

(52) U.S. Cl. ..... 40/781; 40/706

(58) Field of Classification Search ..... 40/780, 40/781, 777, 706, 738
See application file for complete search history.

(56) References Cited

U.S. PATENT DOCUMENTS 1,609,067 A * 11/1926 Cruver ..... 40/781
3,039,217 A * 6/1962 Stefanakis ..... 40/725

* cited by examiner

*Primary Examiner*—Joanne Silbermann
(74) *Attorney, Agent, or Firm*—Charles R. Clark

(57) ABSTRACT

A picture frame assembly incorporates an outer frame and a backing member having at least one laterally extending resilient groove engaging edge protrusion that cooperates with a receiving groove circumscribed, formed, or cast in a back picture opening rabbet return of the outer frame to secure an artwork within the picture frame assembly. Preferably, the backing member has a plurality of resilient groove engaging edge protrusions with each resilient groove engaging edge protrusion cooperating with a receiving groove to secure an artwork within the outer frame. In use, each laterally extending resilient groove engaging edge protrusion is laterally compressed and then rebounds into close engagement with the receiving groove whereby the backing member is secured within the outer frame behind the artwork.

9 Claims, 8 Drawing Sheets

PICTURE FRAME ASSEMBLY INCORPORATING AN OUTER FRAME AND A BACKING MEMBER

CROSS-REFERENCE TO RELATED APPLICATIONS

Not applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, a planar artwork such as a picture, photograph, document, or painting is often displayed in a picture frame assembly having an outer frame. Typically, the artwork is placed in the outer frame from the back side of the outer frame and into a back picture opening rabbet return of the outer frame and is viewed from the front side of the outer frame through a front picture sight opening.

The present invention a picture frame assembly employs a novel backing member as a retaining device. The backing member has at least one laterally extending resilient groove engaging protrusion that engages a cooperating receiving groove along the inner perimeter of a back picture opening rabbet return of an outer frame of the picture frame assembly to retain an artwork within the picture frame assembly. Preferably, the groove engaging protrusion has a straight edge cross-sectional edge profile.

In an assembled picture frame assembly, the backing member has at least one laterally extending resilient groove engaging edge protrusion and at least one resilient elastic slot associated with the groove engaging edge protrusion in a cooperating relationship that pressures the groove engaging edge protrusion outwardly into close, tight, direct contact with a receiving groove of the outer frame with the groove engaging edge protrusion protruding into the receiving groove. The receiving groove along the inner perimeter of the back picture opening rabbet return of the outer frame either partially or fully circumscribes the rabbet return.

Previously, retaining devices such as nails, screws, glazer's points, or wire staples often were used to retain the artwork in the back picture opening rabbet return of the outer frame with the nails, screws, glazer's points, or staples being hammered, driven, or pressed into portions of the outer frame that define the back picture opening rabbet return and with the retaining devices positioned immediately behind the artwork. Use of these prior art retaining devices often has caused damage to the back picture opening rabbet return and such retaining devices often have been difficult to install, manipulate, remove, or replace.

BRIEF SUMMARY OF THE INVENTION

An object of the present invention is to provide a picture frame assembly incorporating a backing member having at least one laterally extending resilient groove engaging edge protrusion and at least one resilient elastic slot associated with each of the resilient groove engaging edge protrusions and preferably incorporating a plurality of laterally extending resilient groove engaging edge protrusions with each groove engaging edge protrusion extending into a corresponding receiving groove circumscribed, formed, routed, or cast in a back picture opening rabbet return of an outer frame of the frame assembly, thereby eliminating the damage caused to the back picture opening rabbet return by use of previously known retaining devices such as nails, screws, glazer's points, or wire staples. In use, the laterally extending resilient groove engaging edge protrusion is pressured by an associated elastically compressed resilient elastic slot into close engagement with the receiving groove by the compressed resilient elastic slot pushing the engaging edge protrusion outward away from the interior of the elastic slot as the elastic slot seeks to rebound to its larger uncompressed shape.

A further object of the invention is to provide a picture frame assembly that can be more conveniently used to secure an artwork in the outer frame and that can be easily opened to allow removal and replacement of the artwork being displayed as determined by a user.

Preferably, the back picture opening rabbet return has at least one receiving groove spaced from a back surface of the outer frame and towards a picture support flange of the outer frame for selection and use with at least one laterally extending resilient groove engaging edge protrusion to secure the backing member in a reversibly fixed physical relationship to the selected receiving groove.

Another objective of this invention is to provide a person with a picture frame assembly that incorporates a backing member as a retaining device that is convenient to use and that is aesthetically attractive and pleasing when used in an outer frame that is made in one piece from transparent materials such as clear cast acrylic plastic sheeting. The invention is a novel picture frame assembly that effectively lessens the visibility of an artwork retaining device that retains an artwork within a transparent picture frame. The invention is particularly useful with outer frames made of hard materials such as cast acrylic sheeting that are not particularly amenable to the use of prior art retaining devices that rely upon penetration into the outer frame by a portion of the retaining device such as a nail, glazer's point, or staple.

Preferably and optimally, the backing member has at least one laterally extending resilient groove engaging edge protrusion on each side of the backing member. During assembly of the picture frame assembly, the groove engaging edge protrusion is laterally and elastically compressed, placed in coplanar alignment with a corresponding receiving groove, and then the resilient groove engaging edge protrusion laterally rebounds and seated in close positional retaining cooperation into the receiving groove. The backing member can have a plurality of laterally extending resilient groove engaging edge protrusions on each side of the backing member. Use of a backing member having a plurality of laterally extending resilient groove engaging edge protrusions can increase the level of securement of the backing member behind an artwork mounted within the picture frame assembly.

The present invention incorporates a secure, uncomplicated relatively unbreakable and inexpensively produced resilient backing member and thereby provides an improved picture frame assembly.

Additional and various other objects and advantages attained by the invention will become more apparent as the specification is read and the accompanying figures are reviewed.

DETAILED DESCRIPTION OF THE INVENTION

Figure 1:
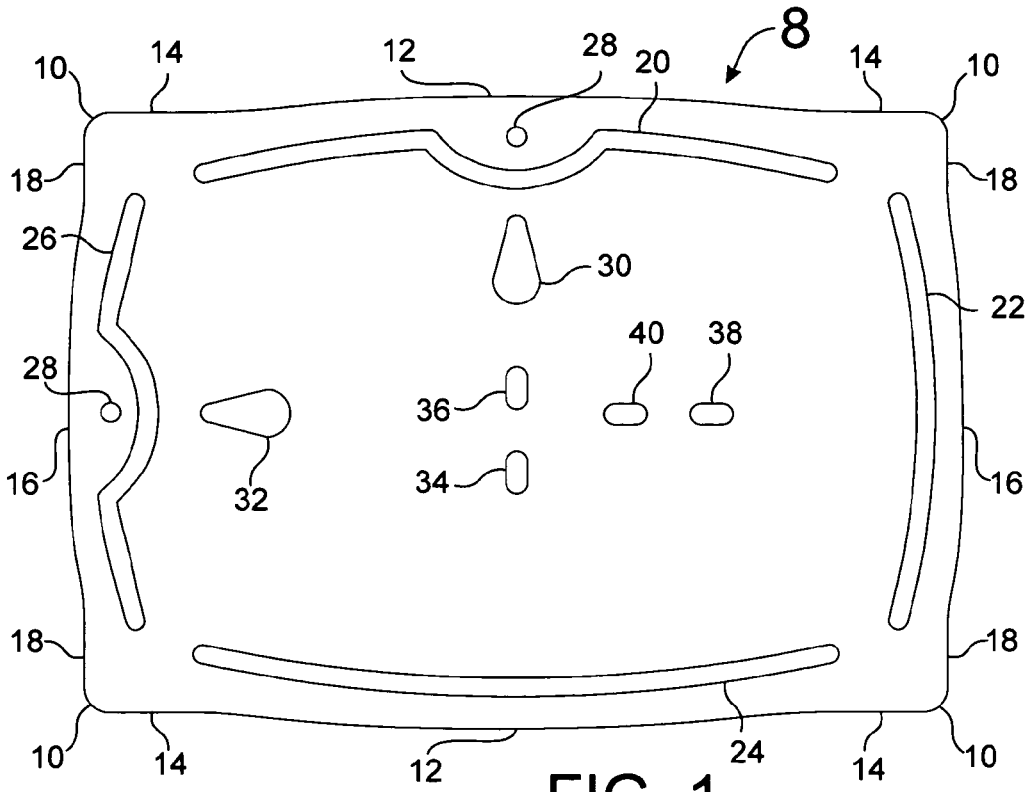
FIG. 1 is a back plan view of a backing member 8 of the preferred embodiment showing four resilient elastic slots 20, 22, 24, and 26 and showing four laterally extending resilient groove engaging edge protrusions 12 and 16.

Referring to FIGS. 1 through 42, the present invention is a novel picture frame assembly 6 or 192 having a backing member 8, 98, 102, 106, 114, 124, 150, 152, 154, 156, 160, 162, 166, 168, 170, 172, 174, 176, 178, 180, 182, 184, 186, 188, 190, or 194, the backing member having at least one laterally extending resilient groove engaging edge protrusion 12, 16, 100, 104, 108, 116, 126, or 196 and having at least one resilient elastic slot 20, 22, 24, 26, or 120 associated with each said groove engaging edge protrusion. The picture frame assembly 6 or 192 further comprises an outer frame 42, 42', 142, 242, 342, 442, 542, 642, or 742 having a back picture opening rabbet return 44 or 744, the rabbet return having at least one receiving groove 60, 60', 110, 112, 118, 120, 122, 660, or 760, the receiving groove receiving and cooperating with at least one laterally extending resilient groove engaging edge protrusion 12, 16, 100, 104, 108, 116, 126, or 196 to reversibly secure the backing member within the outer frame.

Referring to FIG. 1, the backing member 8 is a reasonably rigid panel optimally fabricated from a resilient expanded polyvinyl chloride extruded sheet using a CNC router table such as a ShopBot PRT96 CNC router available from ShopBot Tools, Inc. of Durham, N.C. optimally using a cutter bit available from Magnate, Inc. of Walnut, Calif. as Part No. 1921 having an ⅛ inch cutter diameter. The backing member 8 as shown in FIG. 1 is substantially planar and rectangular in shape having four rounded backing member corners 10.

Optimally, the perimeter of the backing member 8 bulges laterally outward on each side of its four sides near the midpoint of each side forming a laterally extending resilient groove engaging edge protrusion 12, 16. Optimally, the perimeter of the backing member 8 as shown in FIG. 1 is defined starting with a first rounded backing member corner 10 followed by a first pair of straight colinear edge portions 14 or 18 bracketing a first laterally extending resilient groove engaging edge protrusion, followed by a second rounded backing member corner, followed by a second pair of straight colinear edge portions bracketing a second laterally extending resilient groove engaging edge protrusion, followed by a third rounded backing member corner, followed by a third pair of straight colinear edge portions bracketing a third laterally extending resilient groove engaging edge protrusion, followed by a fourth rounded backing member corner, followed by a fourth pair of straight colinear edge portions bracketing a fourth laterally extending resilient groove engaging edge protrusion, and ending with the first backing member corner.

In FIG. 1, paired with each laterally extending resilient groove engaging edge protrusion 12 or 16 is a resilient elastic slot 20, 22, 24, or 26 with each elastic slot extending transversely through the backing member 8. In FIG. 1, a respective edge protrusion retraction bore 28 extending transversely through the backing member 8 is located between the outer edge of a laterally extending resilient groove engaging edge protrusion 12 or 16 and its respective elastic slot 20 or 26.

In FIG. 1, a landscape frame hanging hole 30 and a portrait frame hanging hole 32 are provided in the interior field of the backing member 8 with each hole extending transversely through the backing member and preferably with each hole having a tear-drop shape that can be used to hang the picture frame assembly 6 on a wall or other surface or other object.

In FIG. 1, a landscape frame elastically deformable lower easel securement bore 34 and a landscape frame elastically deformable upper easel securement bore 36 are provided in the interior field of the backing member 8 with each securement bore extending transversely through the backing member and preferably with each securement bore having an elongated shape-elongated along a line between the respective center points of the securement bores.

In FIG. 1, a portrait frame elastically deformable lower easel securement bore 38 and a portrait frame elastically deformable upper easel securement bore 40 are provided in the interior field of the backing member 8 with each securement bore extending transversely through the backing member and preferably with each securement bore having an elongated shape-elongated along a line between the respective center points of the securement bores.

Figure 2:
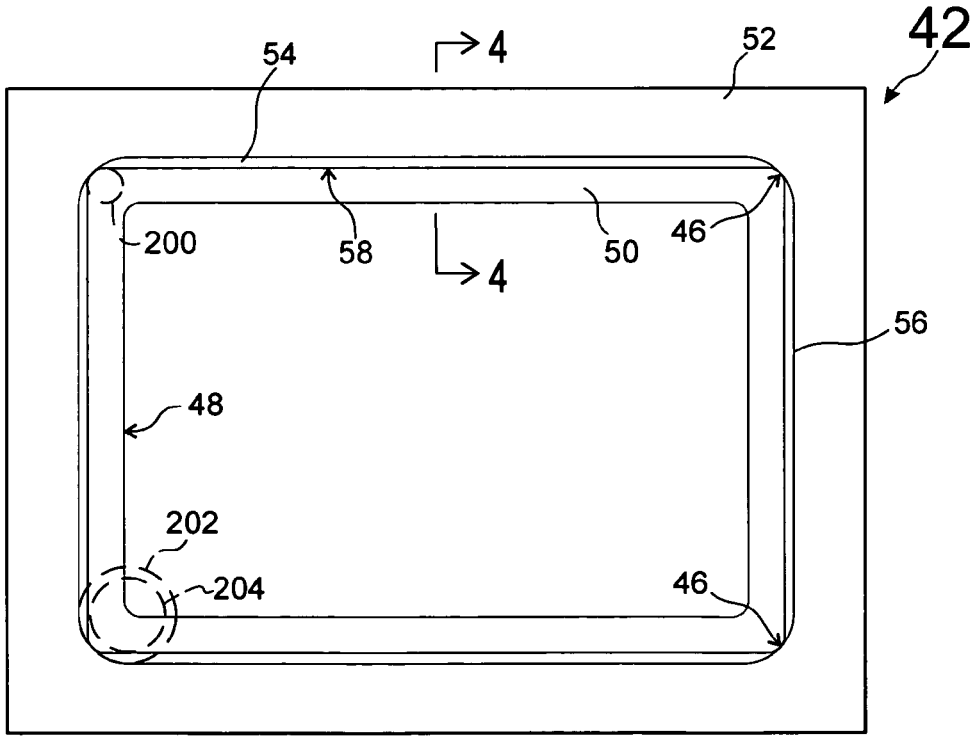
FIG. 2 is a back plan view of an outer frame 42 of the preferred embodiment.
Figure 4:
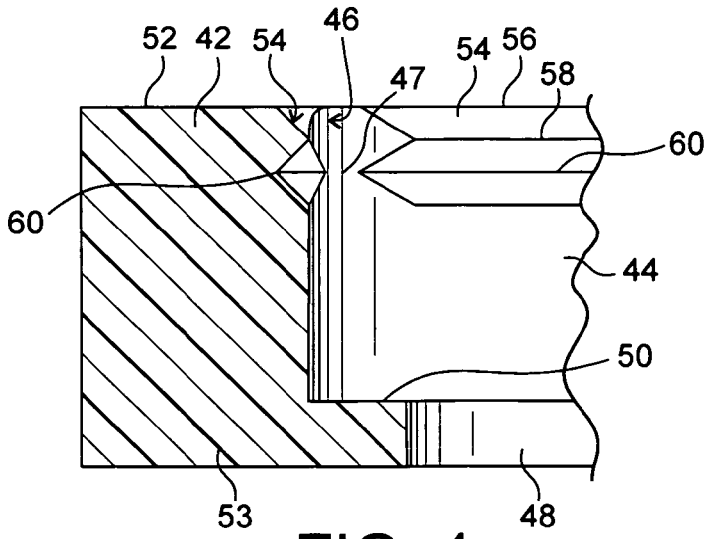
FIG. 4 is a partial sectional view of the outer frame 42 as viewed in direction 4-4 in FIG. 2.

Referring to FIGS. 2 and 4, preferably a picture frame assembly 6 has a generally planar outer frame 42 having a back outer frame surface 52, a back picture opening rabbet return 44, a front picture sight opening 48, and a front outer frame surface 53 (see FIG. 4). Preferably, the back picture opening rabbet return 44 depends inwardly from the back outer frame surface 52 and towards the front outer frame surface 53 and communicates transversely through the outer frame 42 and joins with the front picture sight opening 48.

Preferably, the back picture opening rabbet return 44 has at least one receiving groove 60 circumscribed around the inner perimeter of the back picture opening rabbet return and spaced from the back outer frame surface 52 and towards the front outer frame surface 53.

Figure 6:
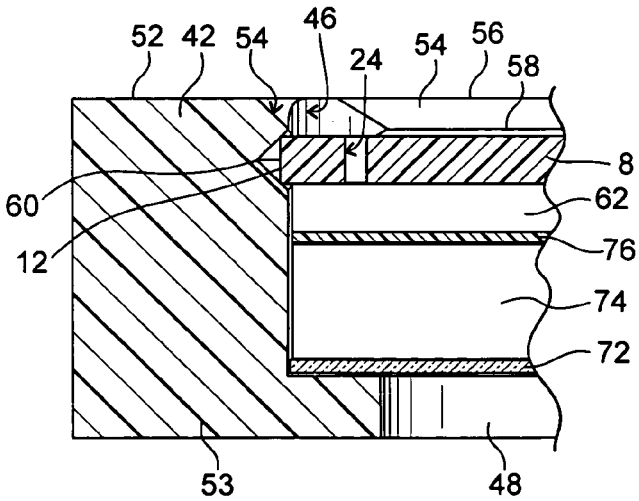
FIG. 6 is a partial, sectional view of the picture frame assembly 6 as viewed in direction 6-6 in FIG. 5.
Figure 7:
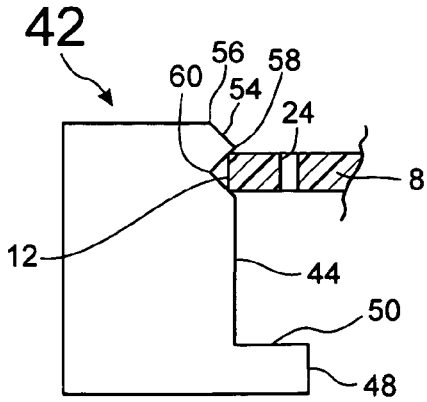
FIG. 7 is a simplified, partial cross-sectional profile of the outer frame 42 and the backing member 8 shown in FIG. 6 showing a laterally extending resilient groove engaging edge protrusion 12 engaged in position extending into a receiving groove 60.
Figure 8:
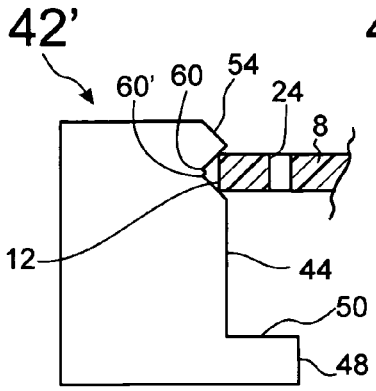
FIG. 8 is a simplified, partial cross-sectional profile of a first alternative outer frame 42', said first alternative outer frame having an overlapping receiving groove 60' and the backing member 8.
Figure 9:
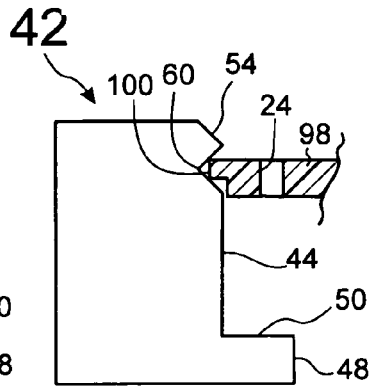
FIG. 9 is a simplified, partial cross-sectional profile of the outer frame 42 and a first alternative backing member 98, said first alternative backing member having a stepped laterally extending resilient groove engaging edge protrusion 100.
Figure 10:
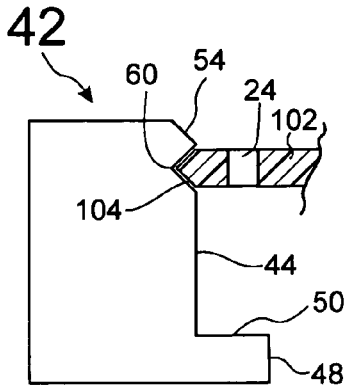
FIG. 10 is a simplified, partial cross-sectional profile of the outer frame 42 and a second alternative backing member 102, said second alternative backing member having a double-beveled laterally extending resilient groove engaging edge protrusion 104.
Figure 11:
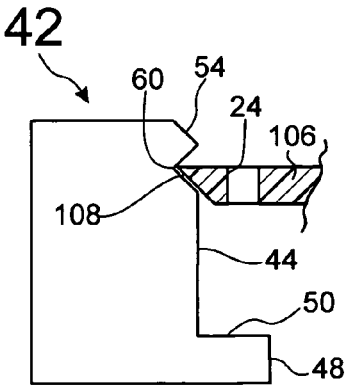
FIG. 11 is a simplified, partial cross-sectional profile of the outer frame 42 and a third alternative backing member 106, said third alternative backing member having a single-beveled laterally extending resilient groove engaging edge protrusion 108.
Figure 12:
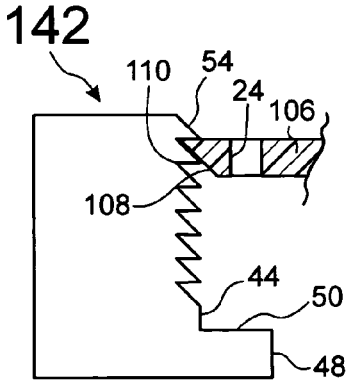
FIG. 12 is a simplified, partial cross-sectional profile of a second alternative outer frame 142, said second alternative outer frame having saw-toothed receiving grooves 110 and the third alternative backing member 106.
Figure 13:
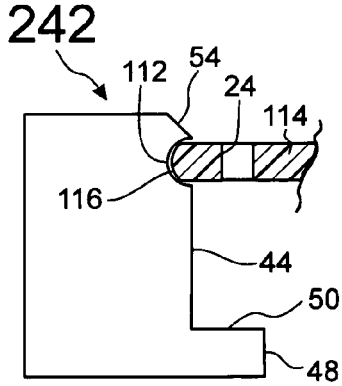
FIG. 13 is a simplified, partial cross-sectional profile of a third alternative outer frame 242, said third alternative outer frame having a rounded receiving groove 112 and a fourth alternative backing member 114, said fourth alternative backing member having a rounded laterally extending resilient groove engaging edge protrusion 116.
Figure 14:
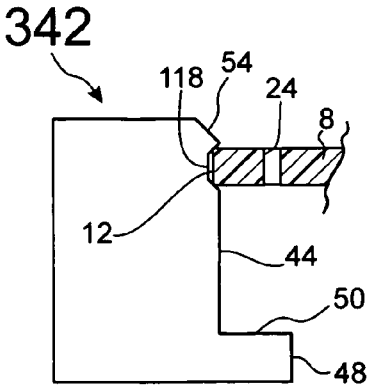
FIG. 14 is a simplified, partial cross-sectional profile of a fourth alternative outer frame 342, said fourth alternative outer frame having a truncated-V receiving groove 118 and the backing member 8.
Figure 15:
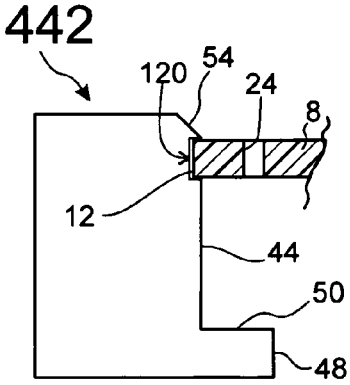
FIG. 15 is a simplified, partial cross-sectional profile of a fifth alternative outer frame 442, said fifth alternative outer frame having a square slotted receiving groove 120 and the backing member 8.
Figure 16:
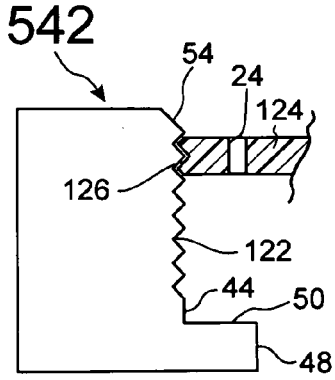
FIG. 16 is a simplified, partial cross-sectional profile of a sixth alternative outer frame 542, said sixth alternative outer frame having symmetrical sawtooth receiving grooves 122 and a fifth alternative backing member 124, said fifth alternative backing member having a symmetrical sawtooth laterally extending resilient groove engaging edge protrusion 126.

Preferably, a picture support flange 50 extends inwardly at the front outer frame surface 53 to define the front picture sight opening 48 and to provide a stop against which a transparent glazing panel 72 can be placed within the picture frame assembly 6 as shown in FIG. 6 and then an artwork 74 can be placed against the glazing panel, and then a protective barrier 76 can be placed against the artwork, and then an inner mat 62 can be placed against the barrier, and then a backing member 8 (the backing member having laterally extending resilient groove engaging edge protrusions 12 and 16) can be placed against the mat, and the laterally extending resilient groove engaging edge protrusions can be seated in a receiving groove 60.

Referring to FIGS. 2 and 4, optimally the outer frame 42 is fabricated from a cast acrylic sheeting using a CNC router table such as a ShopBot PRT 96 CNC router. Optimally the back picture opening rabbet return 44 is routed using a cutter bit available from Magnate, Inc. of Walnut, Calif. as Part No. 1923 having a ¼ inch cutter diameter (see dashed outline of cutter bit circumference 200 in FIG. 2) resulting in four inside radius rabbet return corners 46 each having an ⅛ inch radius.

The receiving groove 60 in the rabbet return 44 is routed using a suitable table mounted router and using optimally a "V" Trim (Face Frame) router bit available from Magnate, Inc. of Walnut, Calif. as Part No. 7001 and having a ⅝ inch cutter diameter (see dashed outline of router bit circumference 204 in FIG. 2) and a ½ inch bearing diameter (see dashed outline of bearing circumference 202 in FIG. 2) producing a receiving groove with a depth of about 1/16 inch along the sides of the rabbet return away from the inside radius rabbet return corners 46 and producing a substantially ungrooved corner portion 47 immediately about the midpoint of the inside radius rabbet return corner as the larger radius bearing of the router bit bridges and transits across each smaller radius inside radius rabbet return corner during the groove cutting process.

Figure 5:
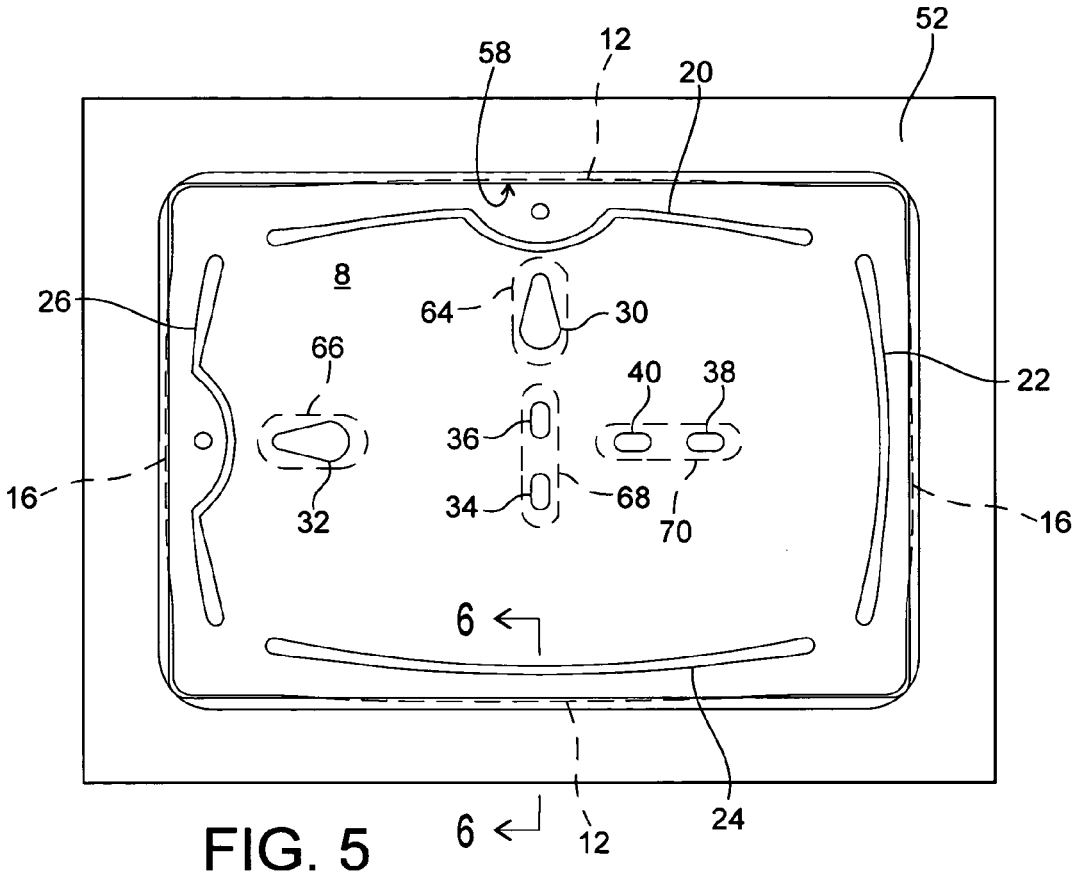
FIG. 5 is a back plan view of a picture frame assembly 6 showing the backing member 8 releasably secured in position in an assembled picture frame assembly.

Referring to FIGS. 4, 5, and 6, in the best embodiment of the picture frame assembly 6 as fully assembled, each rounded backing member corner 10 of the backing member 8 is closely adjacent to a respective ungrooved corner portion 47 of the back picture opening rabbet return 44. In the assembled picture frame assembly 6, the close relationship between each backing member corner 10 and a respective ungrooved corner portion 47 limits the lateral movement of the backing member 8 when the backing member is seated coplanar with the receiving groove 60.

Figure 3:
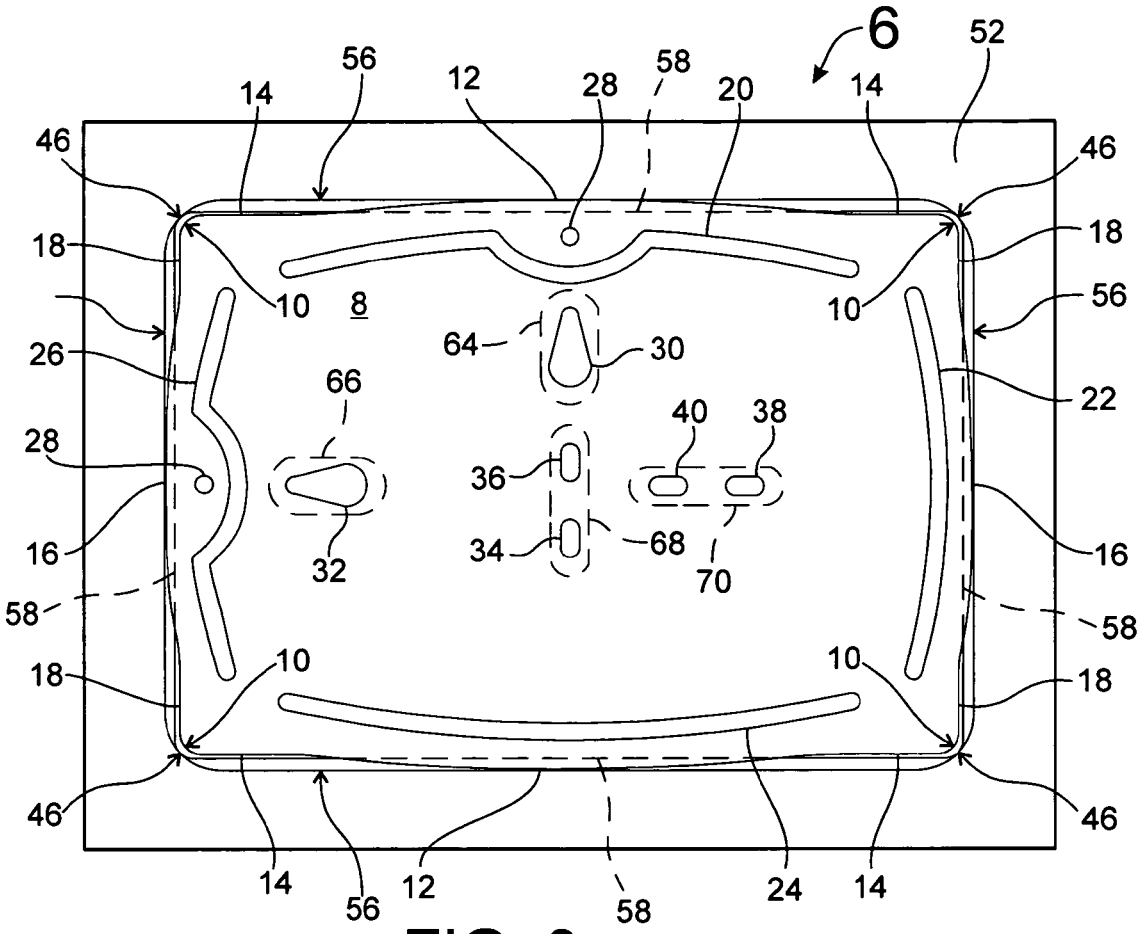
FIG. 3 is a back plan view of a picture frame assembly 6 showing the backing member 8 shown in FIG. 1 not yet inserted into a cooperating receiving groove and overlying the outer frame 42 shown in FIG. 2.

Optimally, as shown in FIGS. 2 through 17, a ramping surface 54 having a ramping surface outer perimeter 56 and a ramping surface inner perimeter 58 is routed along the inner perimeter of the rabbet return 44 at the back surface of outer frame 52. In FIG. 2, the ramping surface outer perimeter 56 is spaced above the bottom of the receiving groove 60 and the ramping surface inner perimeter 58 is spaced above the inner perimeter of the rabbet return 44. During insertion of a backing member into coplanar alignment with a cooperating receiving groove, the ramping surface 54 makes insertion of each laterally extending resilient groove engaging edge protrusion into the cooperating receiving groove easier for a user as the inclined plane of the ramping surface assists the user in laterally compressing each laterally extending resilient groove engaging edge protrusion and its corresponding elastic slot. See FIGS. 6 to 17. Referring to FIG. 3, optimally the laterally extending resilient groove engaging edge protrusions 12 and 16 before insertion into a receiving groove laterally extend outward beyond the inner perimeter of the rabbet return 44 and the ramping surface inner perimeter 58.

Preferably, the generally planar backing member 8 is sized to be received within the back picture opening rabbet return 44 and to cooperate with a corresponding receiving groove 60 to secure an artwork 74 placed previously within the rabbet return. See FIG. 6. As seen in FIG. 1, preferably, a plurality of laterally extending resilient groove engaging edge protrusions 12 and 16 are located distributively around the perimeter of the backing member 8. Preferably, each receiving groove 60 is V-shaped and is sized to receive and cooperate with each laterally extending resilient groove engaging edge protrusion 12 and 16.

Alternatively, the picture frame assembly 6 can be used without a glazing panel 72, without a protective barrier 76, and without an inner mat 62 with the artwork 74 sandwiched between the picture support flange 50 and the backing member 8.

Figure 18:
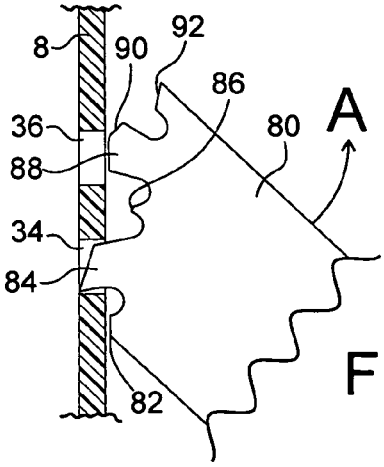
FIG. 18 is a partial sectional view of an easel leg 80 showing a lower easel engagement tab 84 partially inserted into a lower easel securement bore 34.
Figure 19:
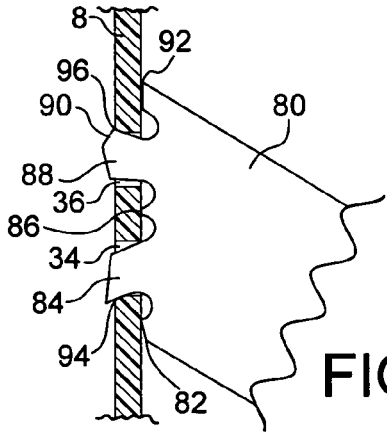
FIG. 19 is a partial sectional view of an easel leg 80 showing a lower easel engagement tab 84 fully inserted into a lower easel securement bore 34 and showing an upper easel engagement tab 88 fully inserted into an upper easel securement bore 36.

In FIG. 18, an easel support leg 80 is shown partially mounted to a backing member 8. As shown in FIG. 18, the backing member 8 has a lower easel securement bore 34 located below an upper easel securement bore 36 and an easel support leg 80 is partially inserted into the lower easel securement bore. As shown in FIG. 19, the easel support leg 80 is mounted to a backing member 8; the easel support leg having at one end a lower buttress portion 82, said lower buttress portion surmounted by a lower easel engagement tab 84, said lower easel engagement tab mountable to a backing member having an elastically deformable lower easel securement bore 34 with a lower portion of lower easel securement bore 94 elastically deformable around a lower portion of said lower easel engagement tab, said lower easel engagement tab surmounted by an intermediate buttress portion 86, said intermediate buttress portion surmounted by an upper easel engagement tab 88, said upper easel engagement tab having an upper ramp portion 90, said upper easel engagement tab mountable to a backing member having an elastically deformable upper easel securement bore 36 with an upper portion of upper easel securement bore 96 elastically deformable around an upper portion of said upper easel engagement tab, and said upper easel engagement tab surmounted by an upper buttress portion 92.

During mounting of an easel support leg 80 to a backing member 8, a lower easel engagement tab 84 is first inserted into a lower easel securement bore 34 and then as the leg begins rotating in the direction A as shown in FIG. 18, the lower easel engagement tab begins elastically deforming a lower portion of lower easel securement bore 94 around a lower portion of the lower easel engagement tab, then as the leg continues rotating, an upper easel engagement tab 88 having an upper ramp portion 90 begins contacting the backing member within an upper easel securement bore 36 and begins elastically deforming an upper portion of upper easel securement bore 96 around an upper portion of the upper easel engagement tab as the upper ramp portion is rotated into and inserted through the upper easel securement bore. Optimally, during and after insertion of the upper easel engagement tab 88 into the upper easel securement bore 36, the upper portion of upper easel securement bore 96 elastically deforms around the upper portion of the upper easel engagement tab.

As shown in FIG. 19, the elastic deformation of the securement bores 34 and 36 by the engagement tabs 84 and 86 secures the easel support leg 80 to the backing member 8.

Figure 17:
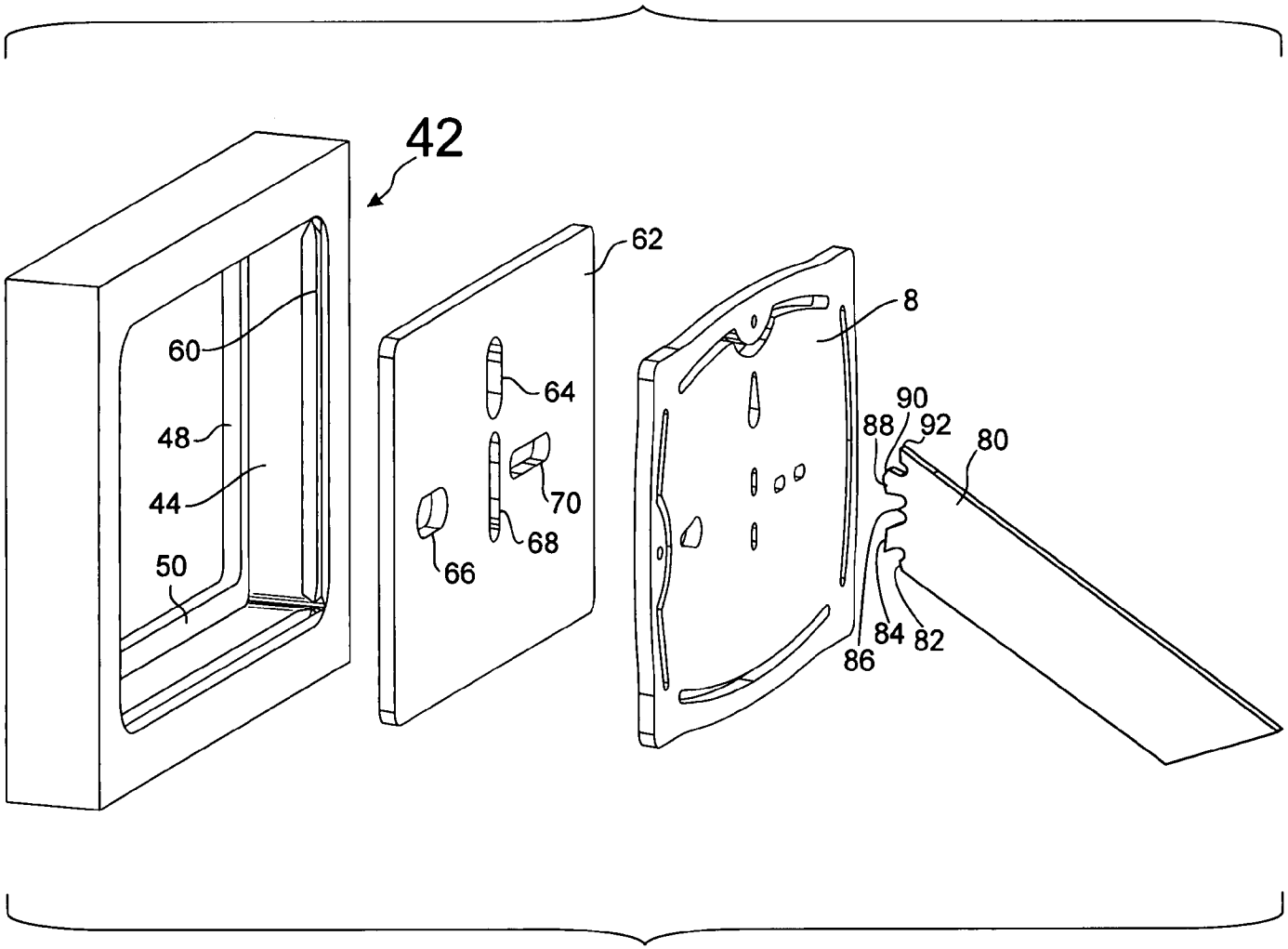
FIG. 17 is an exploded perspective view of the picture frame assembly 6 shown in FIG. 6 additionally showing an inner mat 62 and an easel leg 80 and not showing the transparent glazing panel 72, the artwork 74, and the protective barrier 76 shown in FIG. 6.

FIG. 19 shows in the preferred embodiment, the engagement tabs 84 and 86 protruding through the backing member 8 and FIGS. 3, 5, 6, and 17 show the inclusion of an inner mat 62 adjacent and underlying the backing member. Preferably, as best seen in FIGS. 3, 5, and 17, the inner mat 62 has a landscape frame hanging hole relief 64, a portrait frame hanging hole relief 66, a landscape frame easel securement bore relief 68, and a portrait frame easel securement bore relief 70 with each relief located in the interior field of the inner mat and respectively each relief in the assembled picture frame assembly as seen in FIG. 5 underlying the adjacent backing member and underlying respectively a corresponding landscape frame hanging hole 30, a corresponding portrait frame hanging hole 32, two corresponding securement bores 34 and 36, and two corresponding securement bores 38 and 40 of the adjacent backing member. The inner mat 62 can be made from mat board, foam core board, cardboard, wood, plastic, or other suitable material.

FIG. 6 shows the optional inclusion in the picture frame assembly of a protective barrier 76 interposed between an inner mat 62 and an underlying artwork 74. When included, the barrier 76 can help guard against any damage to the underlying artwork 74 caused by hangers or other objects that are inserted in the various holes, slots, and bores of the backing member 8.

As seen in FIGS. 5 and 6, the outer lateral edges of the laterally extending resilient groove engaging edge protrusions 12 and 16 (protrusion 16 not shown in FIG. 6) of the backing member 8 are secured under the ramping surface inner perimeter 58 and reversibly secured in the receiving groove 60 (groove not shown in FIG. 5).

FIG. 5 shows two edge protrusion retraction bores 28. The retraction bores 28 extend transversely through the backing member 8 and each retraction bore located respectively between a laterally extending resilient groove engaging edge protrusion 12 and 16 and a respective elastic slot 20 and 26. Each retraction bore 28 together with a corresponding hanging hole 30 or 32 can be manipulated by a needle-nose pliers having two nose-tips to retract a corresponding laterally extending resilient groove engaging edge protrusion 12 or 16 from engagement with the receiving groove 60 by first placing a first nose-tip in a bore and a second nose-tip in a corresponding hole and then squeezing the pliers shut whereby the bore and the hole move towards one another and the protrusion is retracted.

Figure 20:
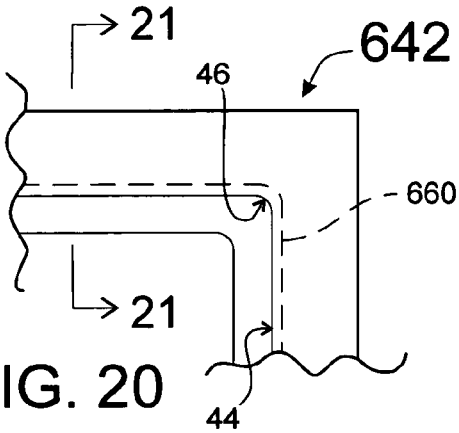
FIG. 20 is a partial back plan view of a seventh alternative outer frame 642.
Figure 21:
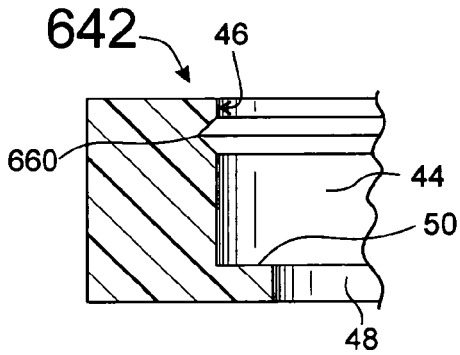
FIG. 21 is a partial sectional view of the seventh alternative outer frame 642 as viewed in direction 21-21 in FIG. 20.
Figure 22:
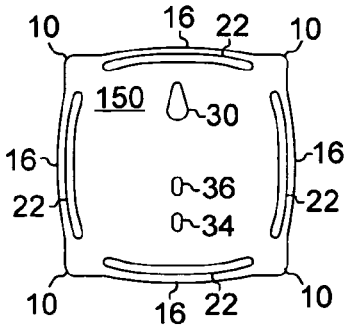
FIG. 22 is a back plan view of a sixth alternative backing member 150.
Figure 23:
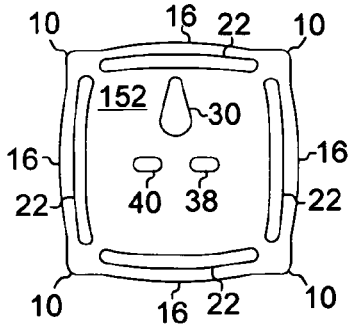
FIG. 23 is a back plan view of a seventh alternative backing member 152.
Figure 24:
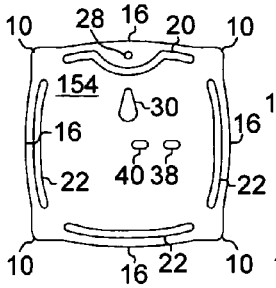
FIG. 24 is a back plan view of a eighth alternative backing member 154.
Figure 25:
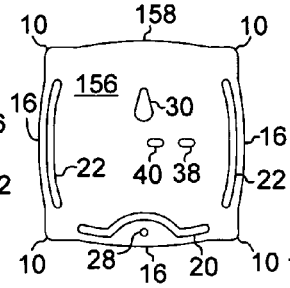
FIG. 25 is a back plan view of a ninth alternative backing member 156.
Figure 26:
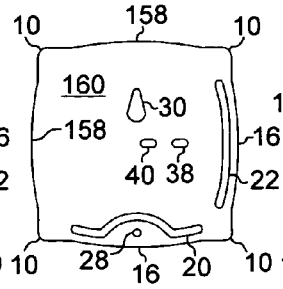
FIG. 26 is a back plan view of a tenth alternative backing member 160.
Figure 27:
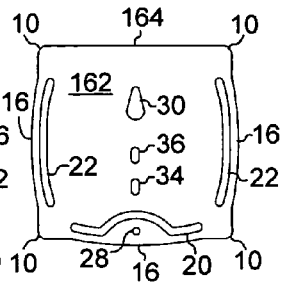
FIG. 27 is a back plan view of a 11th alternative backing member 162.
Figure 28:
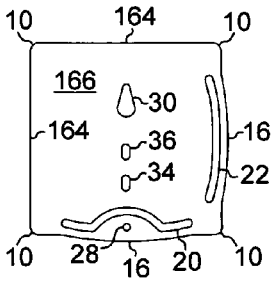
FIG. 28 is a back plan view of a 12th alternative backing member 166.
Figure 29:
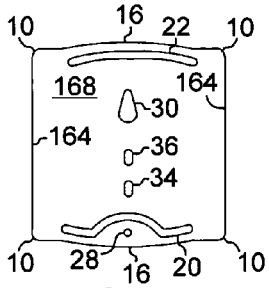
FIG. 29 is a back plan view of a 13th alternative backing member 168.
Figure 30:
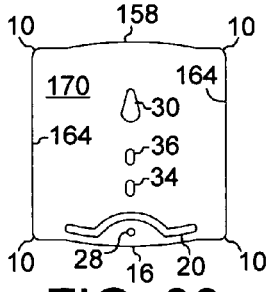
FIG. 30 is a back plan view of a 14th alternative backing member 170.
Figure 31:
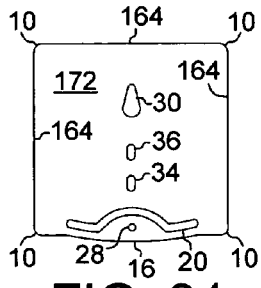
FIG. 31 is a back plan view of a 15th alternative backing member 172.
Figure 32:
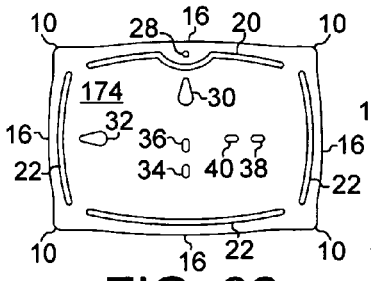
FIG. 32 is a back plan view of a 16th alternative backing member 174.
Figure 33:
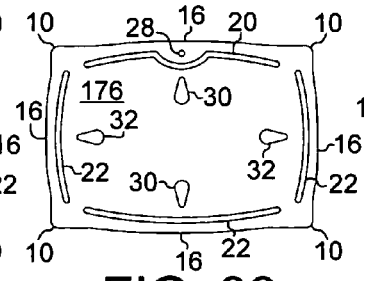
FIG. 33 is a back plan view of a 17th alternative backing member 176.
Figure 34:
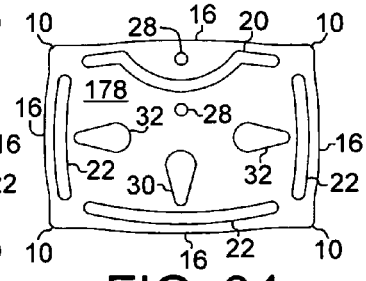
FIG. 34 is a back plan view of a 18th alternative backing member 178.
Figure 35:
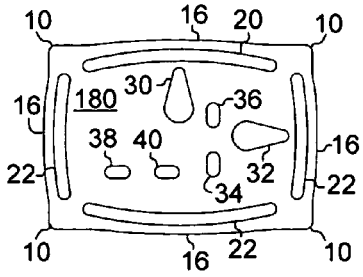
FIG. 35 is a back plan view of a 19th alternative backing member 180.
Figure 36:
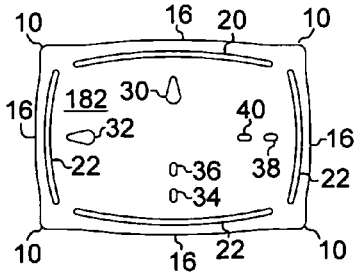
FIG. 36 is a back plan view of a 20th alternative backing member 182.
Figure 37:
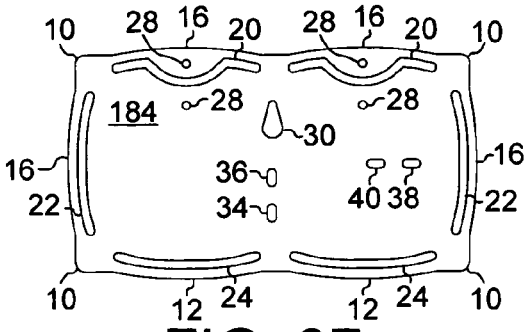
FIG. 37 is a back plan view of a 21st alternative backing member 184.
Figure 38:
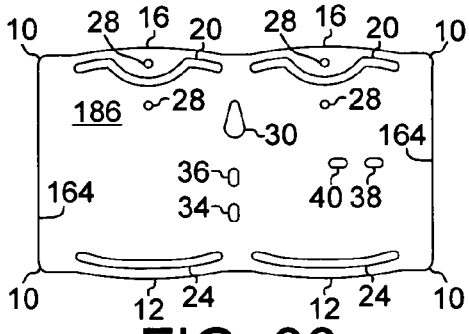
FIG. 38 is a back plan view of a 22nd alternative backing member 186.
Figure 39:
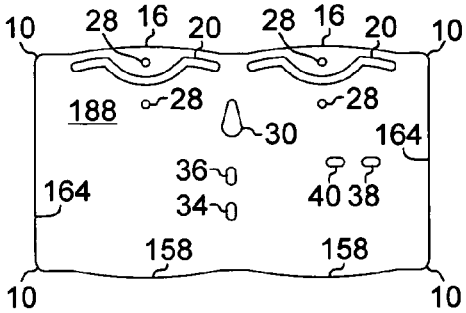
FIG. 39 is a back plan view of a 23rd alternative backing member 188.
Figure 40:
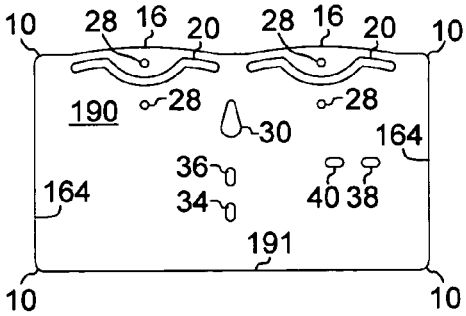
FIG. 40 is a back plan view of a 24th alternative backing member 190.

Referring to FIGS. 20 and 21, a seventh alternative outer frame 642 can have an alternative full-V receiving groove 660 with the full-V receiving groove having uniformly the same depth along the entire inner perimeter of the back picture opening rabbet return 44 including across four inside radius rabbet return corners 46.

A picture frame assembly 6 for the display of an artwork 74 comprises an outer frame 42 having a back outer frame surface 52 and a front outer frame surface 53, a back picture opening rabbet return 44 in said back outer frame surface communicating transversely through said outer frame and joining with a front picture sight opening 48 in said front outer frame surface, said back picture opening rabbet return extending towards said front outer frame surface, said back picture opening rabbet return having rounded inside radius rabbet return corners 46, a picture support flange 50 extending inwardly in said front picture sight opening, said back picture opening rabbet return having a receiving groove 60 circumscribed around the inner perimeter of said back picture opening rabbet return and said groove spaced from said back outer frame surface and from said picture support flange, a backing member 8, said backing member having rounded backing member corners 10, said backing member having at least one laterally extending resilient groove engaging edge protrusion 12 or 16 and at least one resilient elastic slot 20, 22, 24, 26, or 120 associated with each said groove engaging edge protrusion, said backing member sized to be closely received within said back picture opening rabbet return after each said resilient groove engaging edge protrusion is first laterally and elastically compressed inwardly towards the planar center of said backing member and each groove engaging protrusion sized to be received and reversibly retained within said receiving groove.

Referring to FIGS. 25, 26, 30, and 39, alternative backing members 156, 160, 170, and 188 respectively each have at least one laterally extending edge bulge 158.

Referring to FIGS. 27, 28, 29, 30, 31, 38, 39, and 40, alternative backing members 162, 166, 168, 170, 172, 186, 188, and 190 respectively each have at least one straight backing member edge 164 and alternative backing member 190 has an additional straight backing member edge 191.

Figure 41:
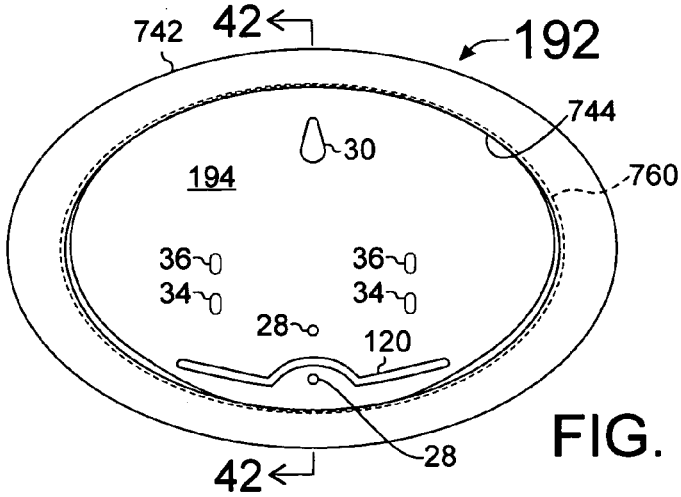
FIG. 41 is a back plan view of an oval picture frame assembly 192.
Figure 42:
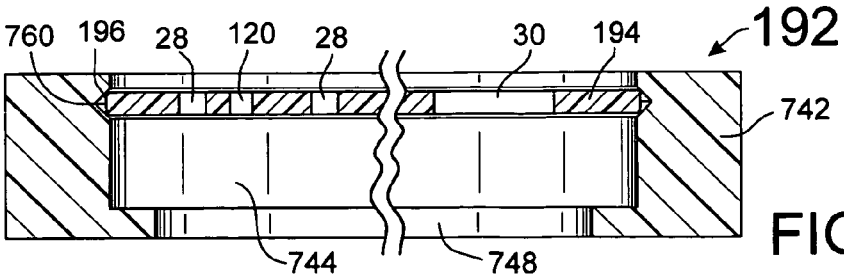
FIG. 42 is a partial sectional view of the picture frame assembly 192 as viewed in direction 42-42 in FIG. 41.

Referring to FIGS. 41 and 42, an alternative oval picture frame assembly 192 has an eighth alternative outer frame 742, said eighth alternative outer frame having an oval back picture opening rabbet return 744 and an oval front picture sight opening 748, said oval back picture opening rabbet return having an oval frame receiving groove 760, and said picture frame assembly having an oval backing member 194, said oval backing member having at least one oval frame laterally extending resilient groove engaging edge protrusion 196.

Preferably, the backing member is made from an expanded polyvinyl chloride sheet product optimally about 3 mm in thickness. The back member can be suitably made from SINTRA® expanded PVC sheet product available from Alcan Composites USA Inc., of Benton, Ky.

Alternatively, the backing member can be made from polyethylene, polypropylene, composite, wood, laminate, or other suitable elastic material that can be formed into a backing member having at least one laterally extending resilient groove engaging edge protrusion and having at least one resilient elastic slot associated with the groove engaging edge protrusion in a cooperating relationship that after the elastic slot is laterally and elastically compressed inwardly then rebounds outwardly and pressures the groove engaging edge protrusion outwardly into a receiving groove as the elastic slot rebounds towards its larger uncompressed shape. The backing member can also be fabricated by injection molding from a resilient polypropylene material or other suitable resilient injection moldable material known in the art.

The picture frame assembly can be fabricated and sized in a range of sizes and the incorporated back picture opening rabbet return and associated backing member can be shaped in a variety of shapes such as square, triangular, rectangular, trapezoidal, pentagonal, hexagonal, octagonal, circular, ellipsoid, and other geometric shapes to accommodate artwork of various sizes and dimensions that a user desires to mount within the picture frame assembly.

Alternatively, the outer frame can be made as a mitered frame assembled from multiple pieces. The outer frame can be made from cast acrylic plastic sheeting, wood, laminate material, metal, glass, ceramic, other plastic material, or other materials known in the art.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A picture frame assembly for the display of artwork comprising an outer frame, having a back outer frame surface and a front outer frame surface, a back picture opening rabbet return in said back outer frame surface communicating transversely through said outer frame and joining with a front picture sight opening in said front outer frame surface, said back picture opening rabbet return extending towards said front outer frame surface, said back picture opening rabbet return having rounded inside radius rabbet return corners, a picture support flange extending inwardly in said picture sight opening, said back picture opening rabbet return having a receiving groove circumscribed around the inner perimeter of said back picture opening rabbet return and said groove spaced from said back outer frame surface and from said picture support flange, a backing member, said backing member having rounded backing member corners, said backing member having at least one laterally extending resilient groove engaging edge protrusion and at least one resilient elastic slot associated with each said groove engaging edge protrusion, said backing member sized to be closely received within said back picture opening rabbet return when each said resilient groove engaging edge protrusion is laterally compressed inwardly towards the planar center of said backing member.

2. A picture frame assembly according to claim 1 wherein each said groove engaging edge protrusion having a straight-edged cross-sectional edge profile.

3. A picture frame assembly according to claim 1 wherein each said groove engaging edge protrusion having a stepped cross-sectional edge profile.

4. A picture frame assembly according to claim 1 wherein each said groove engaging edge protrusion having a single-beveled cross-sectional edge profile.

5. A picture frame assembly according to claim 1 wherein each said groove engaging edge protrusion having a double-beveled cross-sectional edge profile.

6. A picture frame assembly according to claim 1 wherein each said groove engaging edge having a rounded cross-sectional edge profile.

7. A picture frame assembly according to claim 1 wherein each said groove engaging edge having a saw-toothed cross-sectional edge profile.

8. A picture frame assembly according to claim 1 wherein said backing member having an elastically deformable lower easel securement bore and an elastically deformable upper easel securement bore.

9. A picture frame assembly according to claim 8 further comprising an easel support leg, having at one end a lower buttress portion, said lower buttress portion surmounted by a lower easel engagement tab, said lower easel engagement tab mounted in said lower easel securement bore with said lower easel securement bore elastically deformed around the lower portion of said lower easel engagement tab, said lower easel engagement tab surmounted by an intermediate buttress portion, said intermediate buttress portion surmounted by an upper easel engagement tab, said upper easel engagement tab having an upper ramp portion, said upper easel engagement tab mounted in said upper easel securement bore with said upper easel securement bore elastically deformed around the upper portion of said upper easel engagement tab, and said upper easel engagement tab surmounted by an upper buttress portion.

* * * * *